US008651337B2

(12) United States Patent
Quinlan, Jr. et al.

(10) Patent No.: US 8,651,337 B2
(45) Date of Patent: Feb. 18, 2014

(54) FOAM DISPENSER HAVING SELECTIVELY PRESSURIZED CONTAINER

(75) Inventors: Robert L. Quinlan, Jr., Stow, OH (US); Bradley L. Lightner, Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 209 days.

(21) Appl. No.: 13/092,302

(22) Filed: Apr. 22, 2011

(65) Prior Publication Data

US 2012/0267396 A1 Oct. 25, 2012

(51) Int. Cl.
*B67D 7/76* (2010.01)

(52) U.S. Cl.
USPC ..... 222/190; 222/61; 222/195; 222/325; 222/394; 222/396; 222/397; 222/400.5; 222/401

(58) Field of Classification Search
USPC ..... 222/52, 61, 190, 195, 325, 394, 396, 222/397, 400.5, 401
See application file for complete search history.

(56) References Cited

U.S. PATENT DOCUMENTS

| | | | | |
|---|---|---|---|---|
| 5,238,155 | A * | 8/1993 | Blake, III | 222/190 |
| 5,398,845 | A * | 3/1995 | Meyer | 222/1 |
| 5,411,177 | A * | 5/1995 | Blake, III | 222/105 |
| 5,439,140 | A * | 8/1995 | Meyer | 222/110 |
| 5,544,788 | A * | 8/1996 | Meyer | 222/110 |
| 5,772,075 | A * | 6/1998 | Ash et al. | 222/1 |
| 5,842,607 | A * | 12/1998 | Snider | 222/145.6 |
| 5,975,359 | A * | 11/1999 | Van Marcke | 222/82 |
| 6,161,726 | A * | 12/2000 | Parsons et al. | 222/52 |
| 6,308,866 | B1 * | 10/2001 | Hoang et al. | 222/189.11 |
| 6,371,332 | B1 * | 4/2002 | Fox | 222/190 |
| 6,386,403 | B2 * | 5/2002 | Parsons et al. | 222/399 |
| 6,390,340 | B1 * | 5/2002 | Lynch, Sr. | 222/399 |
| 6,419,393 | B1 * | 7/2002 | Shibata | 383/202 |
| 6,698,616 | B2 * | 3/2004 | Hidle et al. | 222/1 |
| 6,941,893 | B2 * | 9/2005 | Gabriel et al. | 119/72.5 |
| 7,635,097 | B2 * | 12/2009 | Mazooji et al. | 239/309 |
| 7,837,132 | B2 * | 11/2010 | Mazooji et al. | 239/263.1 |
| 7,937,836 | B2 * | 5/2011 | Gabriel et al. | 29/890.124 |
| 8,096,445 | B2 * | 1/2012 | Yang et al. | 222/52 |
| 8,109,411 | B2 * | 2/2012 | Yang et al. | 222/52 |
| 8,141,744 | B2 * | 3/2012 | Quinlan | 222/61 |
| 8,215,521 | B2 * | 7/2012 | Quinlan | 222/1 |
| 8,294,585 | B2 * | 10/2012 | Barnhill | 340/573.1 |
| 8,297,277 | B2 * | 10/2012 | Rohrschneider et al. | 128/203.21 |
| 8,313,010 | B2 * | 11/2012 | Quinlan et al. | 222/190 |
| 2007/0163574 | A1 * | 7/2007 | Rohrschneider et al. | 128/200.19 |
| 2010/0102083 | A1 * | 4/2010 | Quinlan | 222/52 |

FOREIGN PATENT DOCUMENTS

| | | |
|---|---|---|
| EP | 0990412 | 8/1993 |
| WO | 90/14037 | 11/1990 |
| WO | 2005/112724 | 12/2005 |

* cited by examiner

*Primary Examiner* — Kevin P Shaver
*Assistant Examiner* — Nicholas J Weiss
(74) *Attorney, Agent, or Firm* — Renner Kenner Greive Bobak Taylor & Weber

(57) ABSTRACT

A dispenser is provided including a dispenser housing that receives disposable refill units that are to be replaced when empty. The dispenser housing includes an air compressor and an inflation plug. The inflation plug includes a needle having an outlet and further includes a vent valve in fluid communication with the outlet. The inflation plug is fluidly associated with the air compressor such that the air compressor selectively advances air to the vent valve and to the outlet of the needle. The disposable refill includes a container having an interior with a liquid portion and air portion therein. The container further includes a plug receipt, and the inflation plug of the dispenser housing engages the plug receipt such that the outlet of the needle communicates with the interior of the container. The air compressor injects air into the interior of the container through the outlet of the needle to increase the pressure inside the container, and the vent valve of the inflation plug opens if the pressure of the container rises above a set threshold.

20 Claims, 11 Drawing Sheets

FOAM DISPENSER HAVING SELECTIVELY PRESSURIZED CONTAINER

FIELD OF THE INVENTION

The invention herein resides in the art of dispensing systems and, more particularly, to dispensers adapted for dispensing materials in the nature of a foam. Specifically, the invention relates to a foam dispenser, in which a foamable liquid is converted into foam by the forceful combination of foamable liquid and air in a foaming head. More particularly, the invention relates to a foam dispenser having a disposable container and adapted for interconnection with a motor-driven air compressor under control of a control circuit to selectively regulate the pressurization of the container and the requisite dispensing of liquid and air to a foam generator to create the desired foam product.

BACKGROUND OF THE INVENTION

Presently in the art of dispensing liquids and gels, it has become desirable to dispense such liquids and gels in the form of a foam. Typically, the foam is generated from combining a liquid or gel material with air in a forceful way, with the combination of air and the liquid or gel then being extruded through a screen, mesh, sponge or the like to obtain a foam of substantially uniform bubbles.

The invention herein will be discussed with regard to soap foam dispensers, in which liquid soap and air are combined as described for achieving the requisite foam. However, it will be appreciated that the concepts of the invention may be extended to the generation of foam from other liquids, gels, and the like, including those of alcohol-based sanitizers. Presently, soap foam is generated in a variety of ways, most of which require the depositing of a quantity of liquid soap in one chamber, an amount of air in another chamber, and compressing the two chambers to forcefully drive liquid and air to a foam generator for the generation of the foam. Such activities require significant mechanical movement, typically employing a pair of pistons, one for liquid and one for air, to drive the separate quantities to the foam generating member. Typically, these dual chambered pumps are an integral portion of disposable containers and add significantly to the cost of such containers. Moreover, being of a mechanical nature, the pumps are not given to excessive use and are typically designed to have a useful life only slightly exceeding the number of dispensing cycles available from the container.

A system is disclosed in Published U.S. Patent Application No. 2010/0102083 having a permanent compressor that is adapted to communicate with replaceable containers to drive both a foamable liquid and air from within the container to a foam generator to form a foam product. A foam dispenser includes a housing that receives a refill unit having a container with an interior containing foamable liquid and air. An air compressor, which is a more permanent part of the dispenser housing, selectively communicates with the air in the container and is employed to inject air into the container so as to increase the pressure therein. An air tube communicates with the air within the container, while a liquid tube communicates with the liquid in the container. Each tube communicates with the container through a plug seal and extends from communication with the container to a dispensing head. Separate valves communicate with each tube such that the tubes can be shut-off so that the container can be pressurized. Once the container is pressurized to a desired dispensing pressure, the valves associated with the liquid and air tubes are opened so that a portion of the foamable liquid and a portion of air are advanced to a foam generator wherein the air and liquid are mixed to create and dispense the foam product.

A pressure sensor and a vent valve are provided as part of the refill unit and communicate with the container so that, in the event that the pressure within the container becomes too large, the vent valve can open to prevent undesired consequences. For example, in the event of a malfunction, it might be possible for the pressure generated by the compressor to burst the container. Also, in the event that the pressure in the container is allowed to become too large (i.e., greater than the desired pressure) it is possible that the air and liquid would be advanced to the foam generator at an undesirably large pressure, leading to an undesired dispensing.

Different methods are proposed for employing the foam dispenser. In one embodiment, the dispenser receives a dispensing request from an individual using the dispenser and, upon receipt of that dispensing request, generates the desired pressure, thereafter opening the valves to permit the dispensing of foam. In a separate method, the dispenser constantly works to establish the desired dispensing pressure in the container such that, when a user places their hands at the appropriate location for a dispensing request, the container is already at the desired dispensing pressure, and valves simply need to be opened to cause the dispensing of product as foam.

The present invention improves upon the invention disclosed above. In the prior invention, the refill units include air and liquid tubes that each communicate with the container through their own separate and distinct plug. Similarly, the compressor, the pressure sensor and the vent valve all separately and distinctly communicate with the contents of the container through one of the container walls. It will be generally understood in the art that these refill units, once empty of product, must be replaced, the dispenser housing being a more permanent structure that simply receives refill units when necessary to replace older units. Employing the structure proposed in the aforementioned publication presents a number of problems in that each plug, sensor and valve that communicates with the container of the refill unit presents a potential area for leakage, thus frustrating the generation of the desired pressure. Also, associating the vent valve and sensor with the container of the refill unit is undesirable inasmuch as the refill unit (and container thereof) is thrown away and replaced when empty. Throwing away the refill unit results in throwing away the vent valve and sensor and thereby increases the cost of the refill unit. As seen in the publication, the air and liquid tubes are plugged into the container at the top thereof such that the tubes are quite long and must be appropriately guided through the structures of the dispenser housing in order to communicate between the top of the container and the outlet area of the dispenser housing. Realizing these problems with the prior publication, the present invention provides a number of structural advancements.

SUMMARY OF THE INVENTION

In one or more embodiments, this invention provides a refill unit for a liquid product dispenser. The refill unit replaces an empty refill unit in the product dispenser, when necessary. The refill unit comprises a container holding a liquid product, the container including a plug receipt providing access to the interior of the container. The plug receipt is structured to receive an inflation plug so as to mate with the inflation plug in a sealed manner. The refill unit further comprises a dispensing nozzle external of the container and fluidly communicating with the liquid product. Pressurizing the container forces liquid out of the container and forces liquid out of the dispensing nozzle. The refill unit is devoid of means for venting pressure generated in the interior of the container other than by venting through the dispensing nozzle.

In one or more embodiments, this invention provides a dispenser. The dispenser includes a dispenser housing and a disposable refill unit separate and distinct from the dispenser housing, the disposable refill unit being replaced when empty. The dispenser housing includes an air compressor. The dispenser also includes an inflation needle that is fluidly associated with the air compressor such that operation of the air compressor advances air through the inflation needle and out an outlet of the inflation needle. The dispenser further includes a vent valve. The disposable refill includes a container having an interior holding a liquid product, and a plug receipt is provided in the container. The refill unit is mounted in the dispenser housing, the inflation needle of the dispenser housing communicates with the interior of the container through the plug receipt, and the vent valve fluidly communicates with the interior of the container. The air compressor communicates with the interior of the container injecting air into the interior of the container through the outlet of the needle to increase the pressure inside the container. The vent valve opens if the pressure of the container rises above a set threshold.

BRIEF DESCRIPTION OF THE DRAWINGS

For a complete understanding of the various aspects and techniques of the invention, reference should be made to the following detailed description and accompanying drawings wherein.

DETAILED DESCRIPTION OF ILLUSTRATIVE EMBODIMENTS

Figure 1:
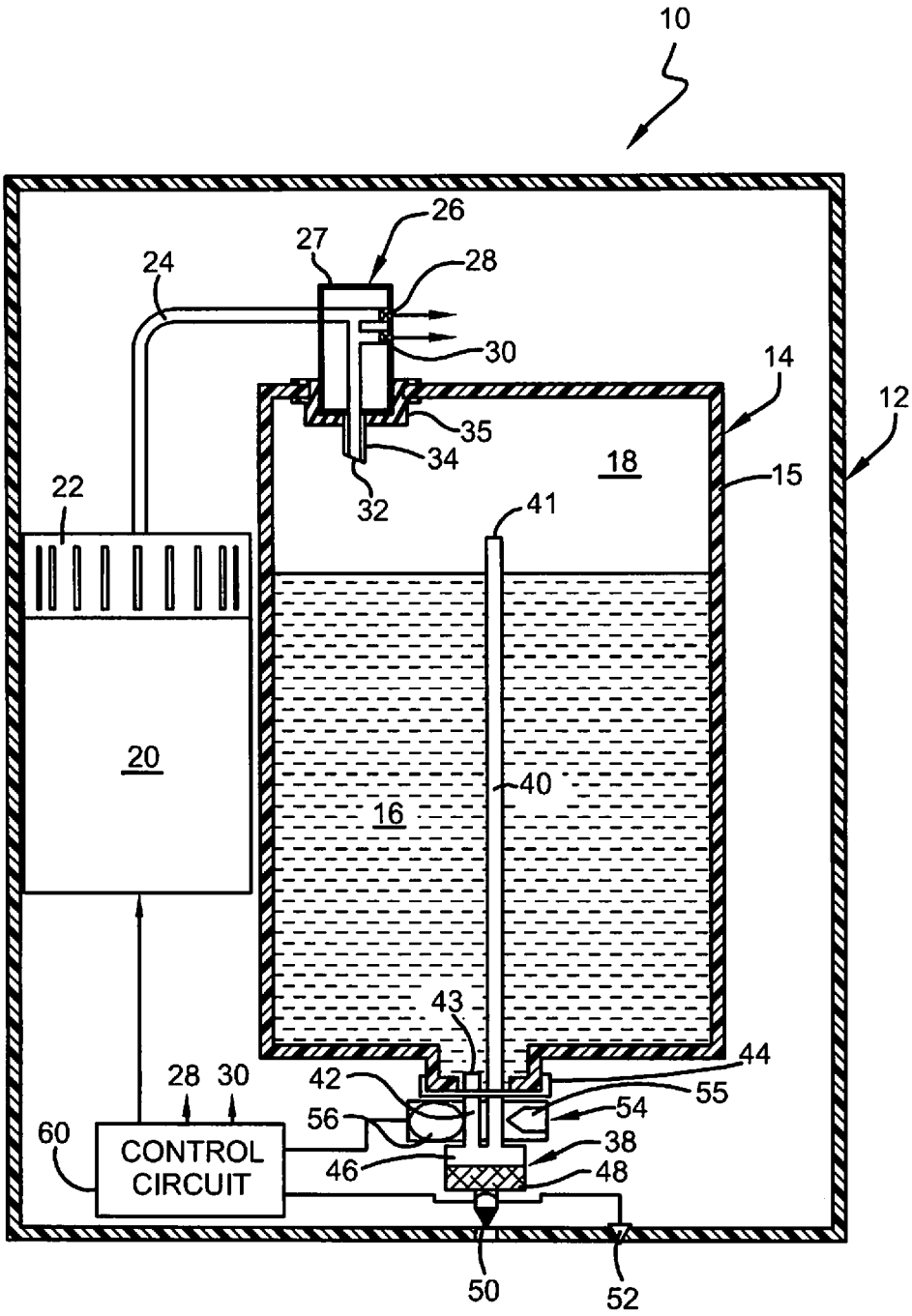
FIG. 1 is a schematic illustrative sectional view of a first embodiment of a foam dispenser made in accordance with the present invention, the foam dispenser having a dispenser housing and a first embodiment of a refill unit received therein, the refill unit having a selectively pressurized container.

A foam dispenser according to this invention is shown in FIG. 1 and designated generally by the numeral 10. The foam dispenser 10 is defined by a housing 12 that receives a refill unit 14 including a container 15 providing a foamable liquid that is to be dispensed as foam, the refill unit 14 being replaced when the container 15 is empty of dispensable liquid. The refill unit 14 further includes a foam-generator 38 that will be described more particularly herein. The dispenser housing 12 may be either a wall-mount or counter-mount type. In a wall-mount configuration, the dispenser 10 schematically represented in FIG. 1 would have a dispenser housing 12 mounted to a wall, with the interior of the dispenser housing 12 being accessible to insert, remove and replace refill units 14 as necessary. Similarly, in a counter-mount configuration, the dispenser 10 would have a dispenser housing 12 mounted to (or even just resting on) a counter, with the interior of the dispenser housing 12 being accessible to insert, remove and replace refill units 14, as necessary. Typically, the housing 12 will have a hinged front or cover to allow access to the interior thereof for replacement of the refill unit 14, as desired. In some embodiments of particular interest, the liquid retained in the container 15 is either a liquid soap or sanitizing gel, both being capable of foaming. The refill unit 14 is a removable, disposable and replaceable unit, as that feature is readily known and understood in the art. Typically, the container 15 of the refill unit 14 is blow-molded of an appropriate plastic material. Because the container is to be pressurized, it should be formed of materials suitable to withstand the pressurization during the life of the refill unit 14. The container 15 could be a multi-walled container or even a bag. In particular embodiments, the container is formed of polyethylene terapthalate (PET).

The refill unit 14 is adapted to dispense in a downward direction, such that the liquid in the container 15 defines a liquid portion 16 in a lower portion of the container and an air portion 18 thereabove. The liquid portion 16 and air portion 18 comprise substantially the entirety of the interior of the container 15, the air and foamable liquid being in contact with each other, without the use of a separating bladder, membrane or the like. As will become apparent herein, the air portion 18 is selectively pressurized to create a pressure head within the container 15 to assist in the dispensing operation.

Received and maintained within the housing 12 as a more permanent portion thereof is a motor 20 operative to drive an air compressor 22. A compressor tube 24 extends from the air compressor 22 to an inflation plug 26 that selectively interacts with the refill unit 14 received in the dispenser housing 12.

The compressor tube 24 and inflation plug 26 also remain a more permanent part of the dispenser housing 12. By the terms "more permanent part" as used to modify the motor 20, compressor 22, compressor tube 24 and inflation plug 26 it is meant that these elements are intended to remain associated with the dispenser housing 12 and to last for a significant time, which desirably will be for the life of the dispenser housing 12. Their useful time span is "more permanent" as compared to the refill units 14 that are intended to be removed (when empty or malfunctioning) and replaced (to provide new product for dispensing). The intent is that the motor 20, compressor 22, compressor tube 24 and inflation plug 26 are to last for the life of the dispenser, but they may, of course, have to be replaced due to unexpected failure or malfunction, just as with the components of any device.

In one or more embodiments, the inflation plug 26 includes a body 27 into which the tube 24 extends, the tube 24 branching to communicate with a pressure sensor 28 and vent valve 30, both of which are part of the inflation plug 26. The pressure sensor 28 produces a signal corresponding to the pressure head in the air portion 18 of the unit 14, while the vent valve 30 is operative to vent the air chamber 18 to atmosphere, as desired. The tube 24 also branches to provide an outlet 32 at a piercing needle 34. In other embodiments, the pressure sensor 28 and the vent valve 30 may be located elsewhere.

The needle 34 serves to extend through a plug receipt 35 in the container 15 so that the compressor 22 can inject air into the air portion 18 to pressurize the container 15. The plug receipt 35 and inflation plug 26 can interact in any number of ways. The plug receipt 35, prior to interacting with the needle 34, is whole and uncompromised so that foamable liquid and air are sealed in the container 15. When the needle 34 interacts with the plug receipt 35, the plug receipt 35 is compromised and the needle 34 extends into the interior of the container 15. Many options are available for the needle 34 and plug receipt 35, for example, the plug receipt 35 could provide (a) a membrane to be pierced by the needle 34, (b) a puncturable orifice to be punctured by the needle 34, (c) or a flapper valve through which the needle 34 would extend. The person mounting the refill unit 14 to the dispenser housing 12 inserts the needle 34 of the inflation plug 26 through the plug receipt 35 so that the compressor 22 can inject air into the container 15 at the outlet 32 of the tube 24. The plug receipt 35 is preferably formed of a resilient material, such as an elastomer or rubber, and preferably is sized so as to squeeze against the needle 34 or body 27 or both to thereby create a tight seal that would prevent air from leaking from the container 15 at the compromised puncturable wall 4.

Figure 3:
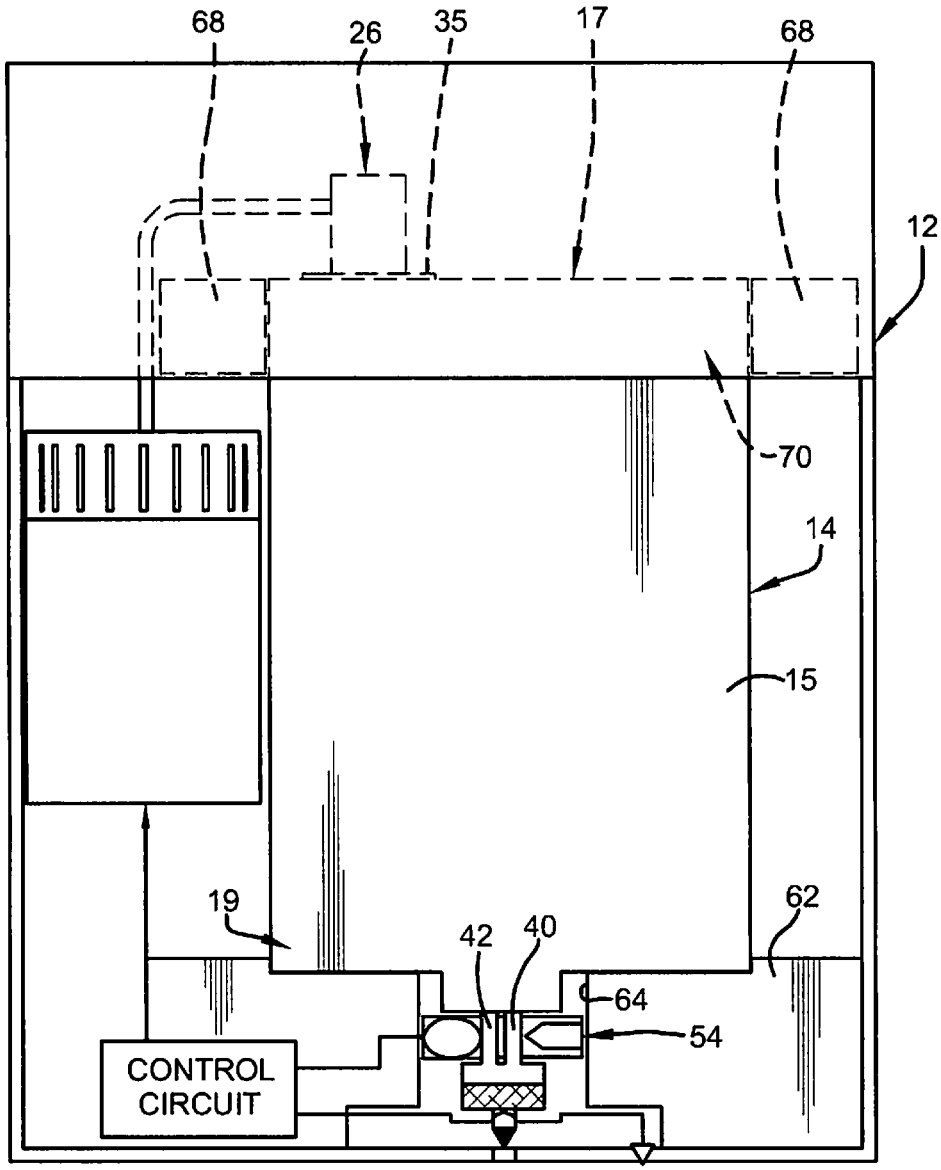
FIG. 3 is a schematic illustrative sectional view of a structure and method for mounting refill units in accordance with this invention to a dispenser housing, the structure and method being specifically applicable to the embodiments of FIGS. 1, 2, 4 and 5.

In one or more embodiments of this invention, a person may access and grasp the inflation plug and mate it with the plug receipt, though, in other embodiments, such as that disclosed with respect to FIG. 3, the dispenser housing and refill unit can be structures so that the inflation plug and plug receipt mate upon proper installation of the refill unit, without the need for the manual manipulation of the inflation plug.

Figure 9:
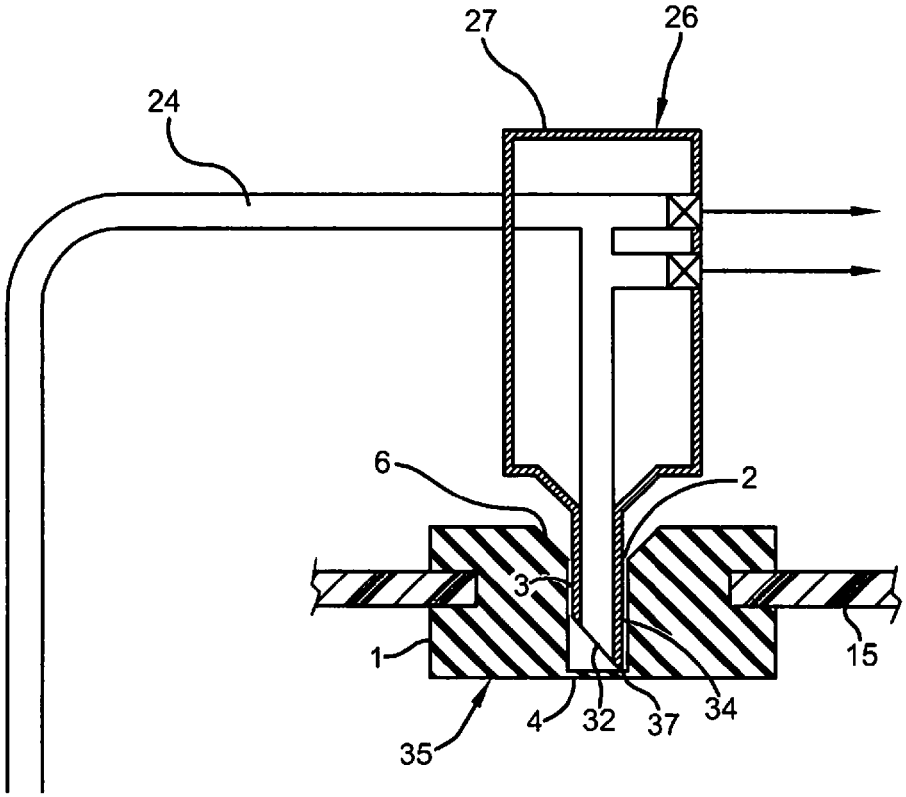
FIG. 9 is a first embodiment of an exemplary inflation plug and plug receipt, shown before the mating of the plug and plug receipt.
Figure 4:
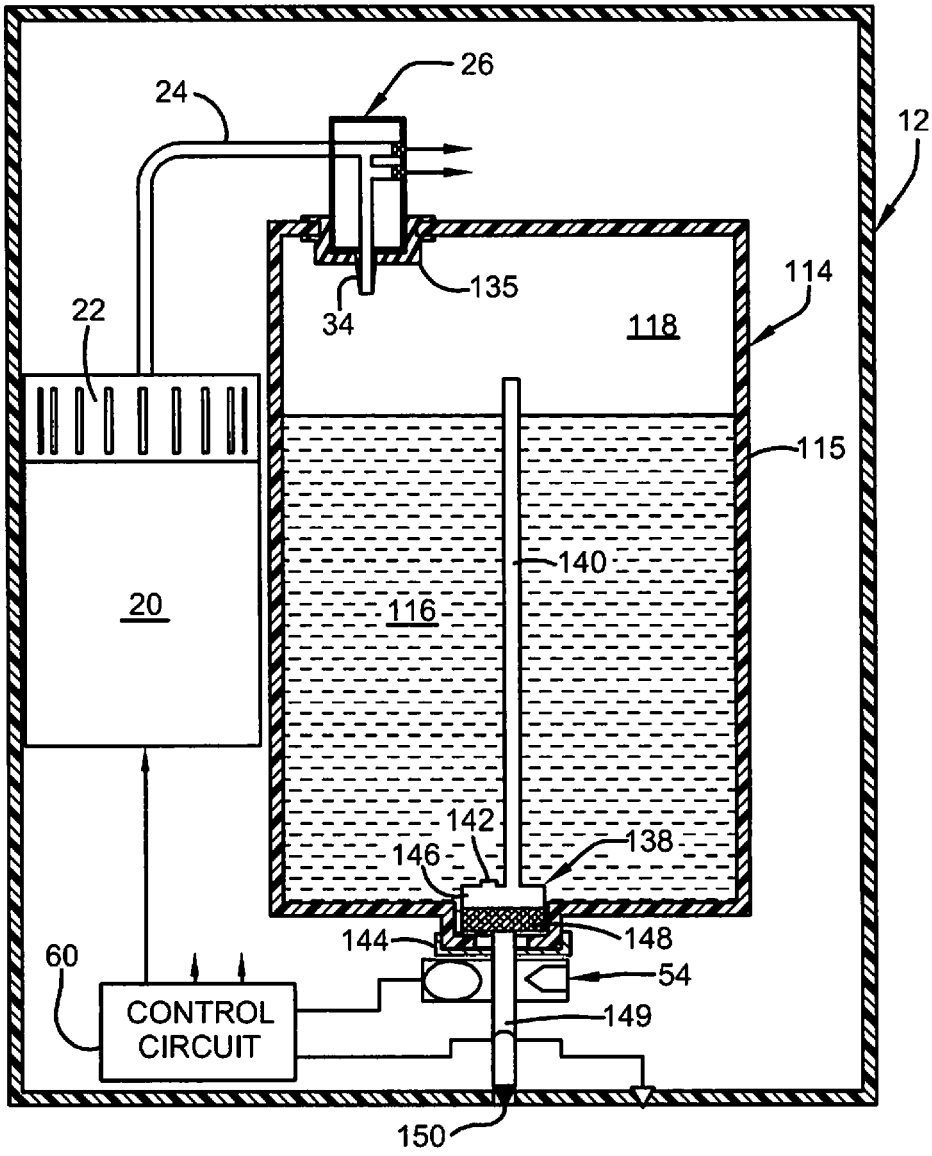
FIG. 4 is a schematic illustrative sectional view of a third embodiment of a foam dispenser, and this third embodiment differs from that of FIGS. 1 and 2 by providing a foam generator inside of the container of the refill unit.
Figure 6:
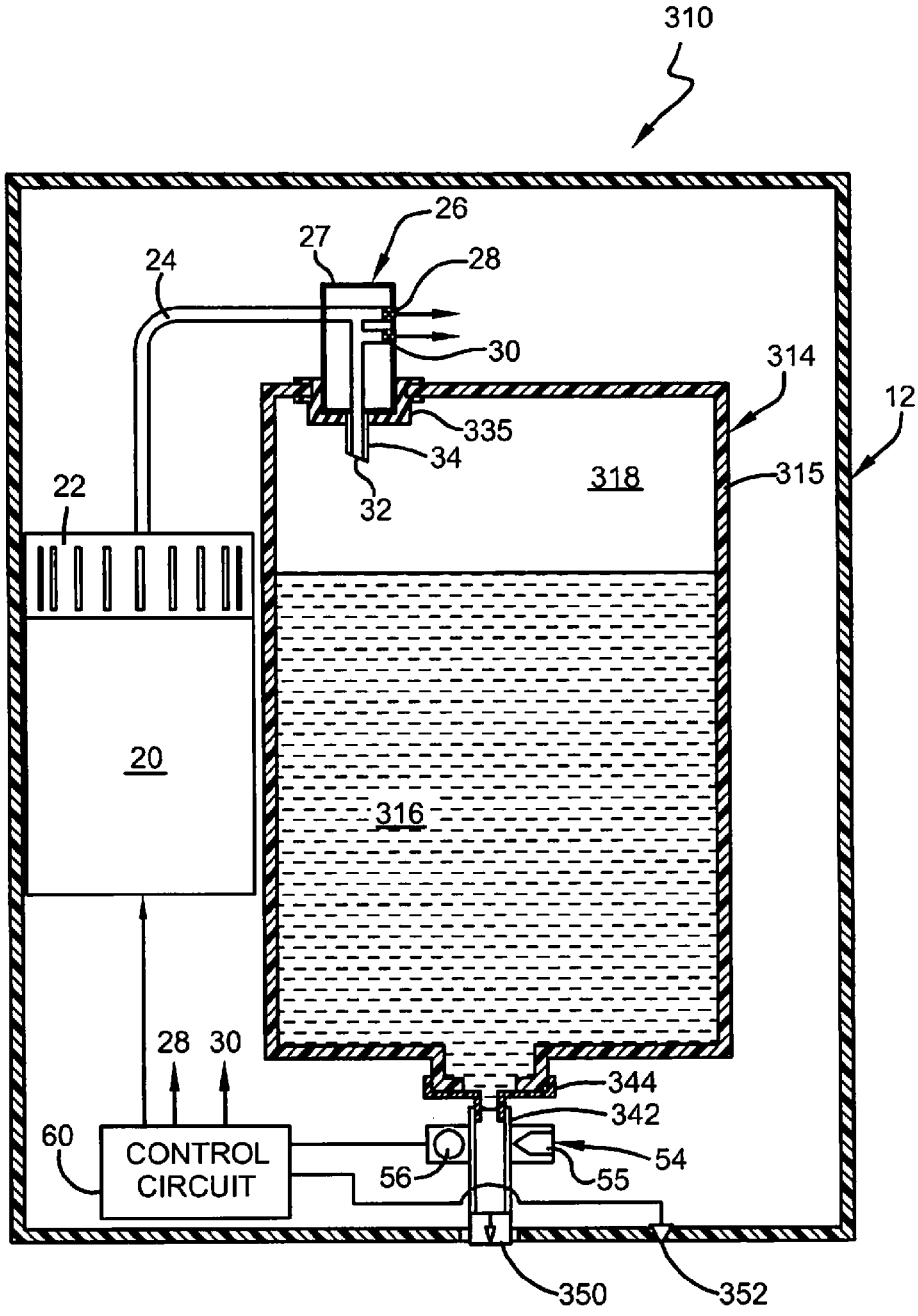
FIG. 6 is a schematic illustrative sectional view of a fifth embodiment of a dispenser made in accordance with the present invention, but wherein the dispenser in not a foam dispenser and instead dispenses liquid product that has not been foamed.

A first exemplary embodiment of an inflation plug and plug receipt is shown in FIGS. 1, 4 and 6, with the inflation plug and plug receipt shown mated together. In FIG. 9, an alternative exemplary embodiment is shown before the inflation plug is mated with the plug receipt. In this embodiment, the plug receipt 35 is provided as a grommet 1 that is sealed to (or formed as part of) the container 15. The grommet 1 has an open end 2 providing access to a passage 3 leading to a puncturable wall 4. The needle 34 includes a distal end 37 that is sharp enough to readily pierce the puncturable wall 4 so that the compressor 22 can inject air into the container 15 at the outlet 32, which fluidly communicates with the compressor through tube 24. To assist in the insertion of the needle 34, the open end 2 can be formed with a beveled shape (as at numeral 6) that would help to align and urge the needle 34 into the passage 3. The grommet 1 is preferably formed of a resilient material, such as an elastomer or rubber, and preferably is sized so as to squeeze against the needle 34 or body 27 or both to thereby create a tight seal that would prevent air from leaking from the container 15 at the compromised puncturable wall 4.

Figure 10:
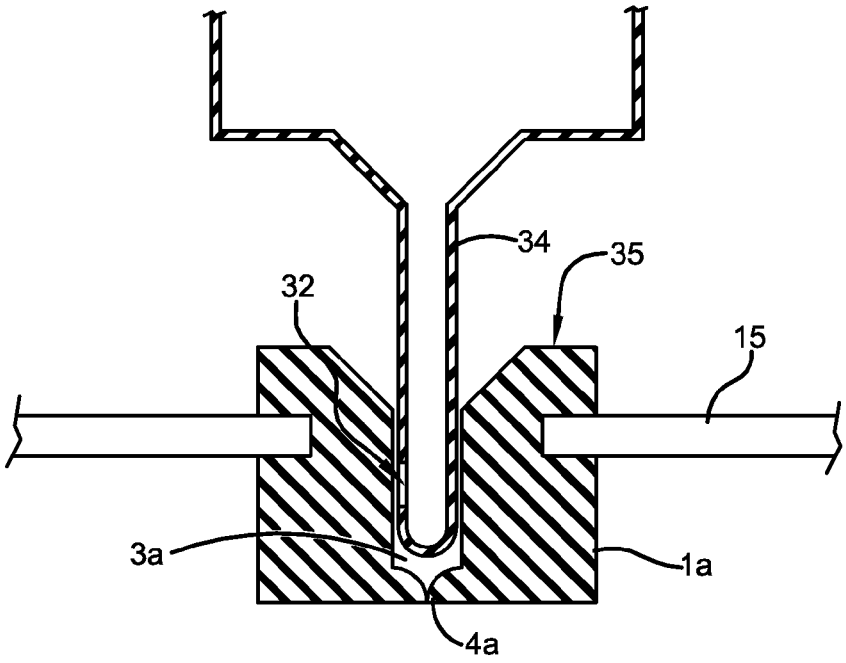
FIG. 10 is another embodiment of an exemplary inflation plug and plug receipt, shown before the mating of the plug and plug receipt.
Figure 11:
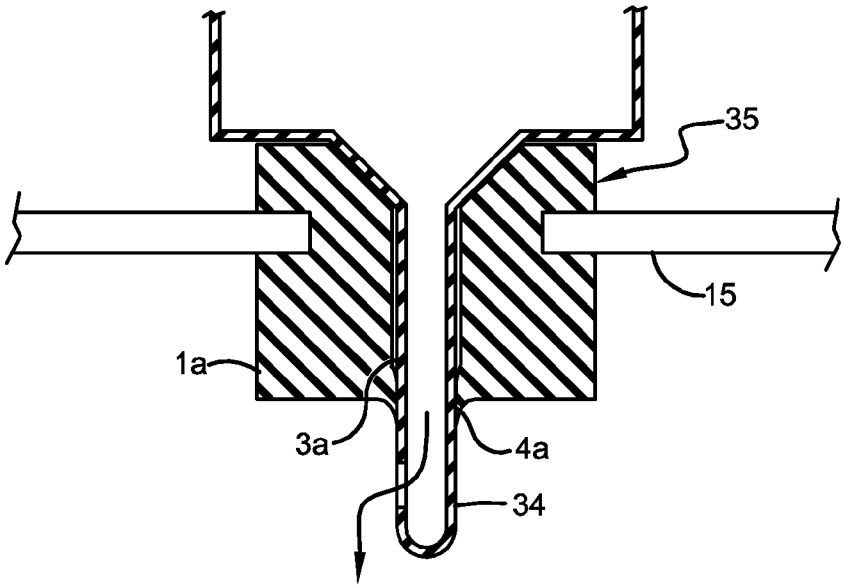
FIG. 11 shows the embodiment of the exemplary inflation plug of FIG. 10, shown after mating the plug and plug receipt.

FIGS. 10 and 11 provide yet another exemplary embodiment of a plug receipt. The plug receipt 35 shown therein is formed in a manner similar to the valves for the inflation of sports balls (e.g. soccer, rugby, American football, and basketball). A grommet 1*a* defines a passage 3*a* having a self-sealing end 4*a*, and an inflation needle 34 can be forced therethrough to place an outlet 32 thereof at the interior of the container 15. The self-sealing end 4*a* seals against the needle 34 after insertion to prevent leakage. The needle 34 can be blunt at its distal end, as it is not puncturing a wall but is rather being forced through a resilient restriction at the self-sealing end 4*a*. Additionally, the outlet 32 can be on the side of the needle 34. Although not shown, the plug 26 providing the needle 34 can include a sensor and vent valve. It should be appreciated that the term "self-sealing passage" as used herein and particularly in the claims is to be interpreted in light of such valves for the inflation of sports balls. The needle, once inserted can pressurize the container. As with the embodiment of FIG. 9, beveled surfaces and the like could be employed, as shown, to facilitate the alignment of the needle with the self-sealing passage and its insertion therethrough.

In the embodiment of FIG. 1, the refill unit 14 includes a foam generator 38 and an air tube 40 and a liquid tube 42 fluidly communicating with the foam generator 38. In this embodiment, the foam generator 38 is outside of the interior volume of the unit 14, and the air tube 40 extends from one end in fluid communication with the foam generator 38 to an inlet end 41 in direct communication with the air portion 18 inside the volume of the container 15. Similarly, the liquid tube 42 extends from one end in fluid communication with the foam generator 38 to an inlet end 43 in direct communication with the liquid portion 16 inside the volume of the container 15. In this embodiment, both the air tube 40 and liquid tube 42 extend from the exterior to the interior of the container 15 through a sealing cap 44, and extend through the sealing cap 44 in a fluid-tight manner so as to prevent leakage and dripping, even when the unit is under pressure. For example, the tubes could be molded to be part of the sealing cap 44. They could alternatively be mounted through apertures in the cap 44, using O-ring-type seals to prevent leakage.

The foam generator 38 includes a mixing chamber 46 having an homogenizing member 48 therein. Those skilled in the art will appreciate that the mixing chamber is substantially a confined volume in which the liquid product and air are forcefully combined to create a premixture of foamable liquid and air. This premixture is a coarse mixture of air bubbles in liquid, and it is extruded through the homogenizing member 48, which is typically a screen mesh, sponge, foam block or the like, to more homogeneously disperse the air throughout the liquid and thereby create a foam product. After extrusion through the homogenizing member 48, the liquid product is dispensed as foam out of the dispensing nozzle 50. An aperture 51 is shown in housing 12 to schematically represent that the nozzle 50 communicates with the exterior of the housing 12.

The foam dispenser 10 also includes a hand detector or proximity sensor 52, which may be of any of various types understood by those skilled in the art. The proximity sensor 52 emits a signal upon sensing the presence of an object at the area the sensor 52 monitors. Typically, the sensor 52 senses the presence of a user's hand or hands at the proper dispensing location, particularly in embodiments wherein foamed soap or foamed sanitizer is dispensed onto a user's hand. In the present embodiment, the sensor 52 would monitor the area under the dispensing nozzle 50 and would send a signal when an object (e.g., a user's hand) is under the dispensing nozzle 50.

In this embodiment, a single shut-off valve 54 serves to selectively open and close the air tube 40 and the liquid tube 42. Virtually any configuration of components suitable for selectively opening and closing the air tube 40 and liquid tube 42 can be employed, as structures and methods achieving such function are numerous and well known. In one embodiment of this invention, the air tube 40 and the liquid tube 42 are, at least at their length outside of container 15, made of flexible tubing, and, in such an embodiment, the shut-off valve 54 may consist of elements that selectively pinch close the flexible tubing of the tubes 40, 42. By way of example, the shut-off valve 54 of the embodiment of FIG. 1 could include a sealing bar 55 positioned on either side of both tubes 40 and 42, with a stop plate 56 positioned on the other side so that the sealing bar 55 is moved by the control circuit 60 (disclose below) to press both tubes 40 and 42 against the stop plate 56 to close them off.

Figure 2:
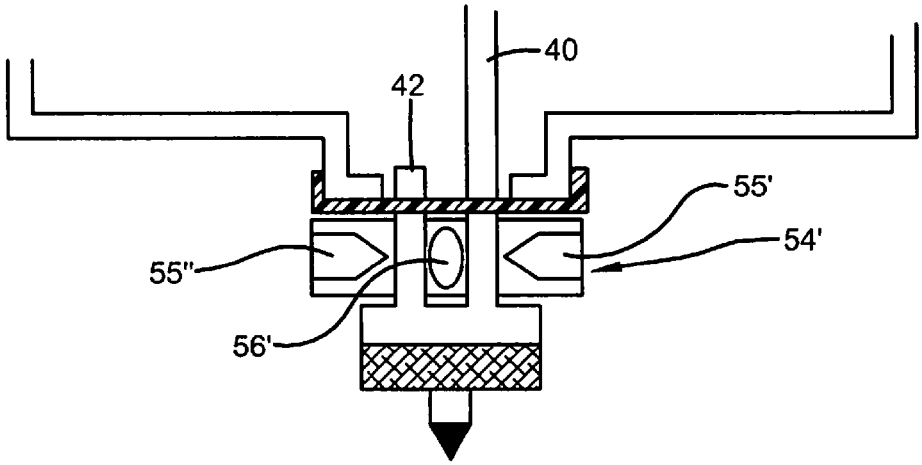
FIG. 2 is a schematic illustrative sectional view of a second embodiment of a foam dispenser, and this second embodiment differs from that of FIG. 1 due to an alternative construct for tube and valve structures of the refill unit.

In other embodiments of a refill unit, such as that shown in FIG. 2, two shut-off valves are employed, one for the air tube 40 and one for the liquid tube 42. In this embodiment, a valve 54' can be employed. The valve 54' includes a single stop plate 56' positioned between the air tube 40 and the liquid tube 42 so that a separate air sealing bar 55' and liquid sealing bar 55" can each separately move to press against the stop plate 56 and close off their respective tubes.

Figure 12:
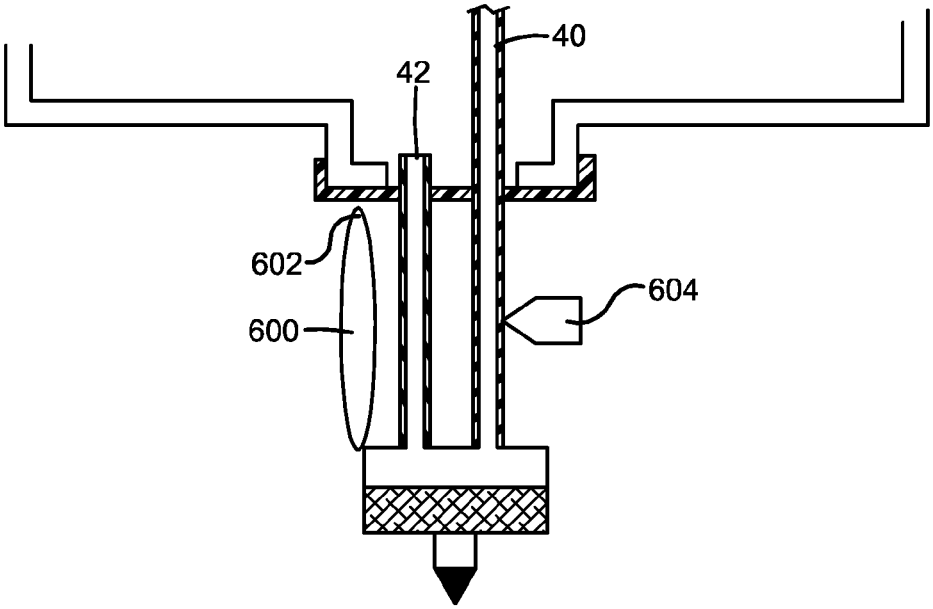
FIG. 12 provides a more detailed view of an exemplary embodiment of a valve for closing an air tube and liquid tube of a refill unit such as that employed in FIG. 1, shown with the valve moved so that fluid can flow through those tubes.
Figure 13:
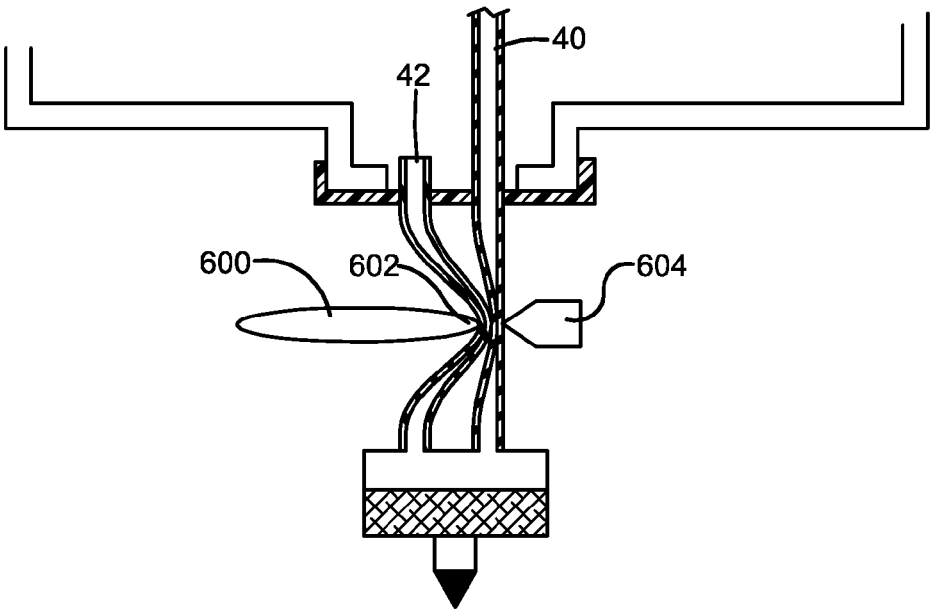
FIG. 13 shows the valve of FIG. 12 moved to close the air tube and liquid tube.
Figure 14:
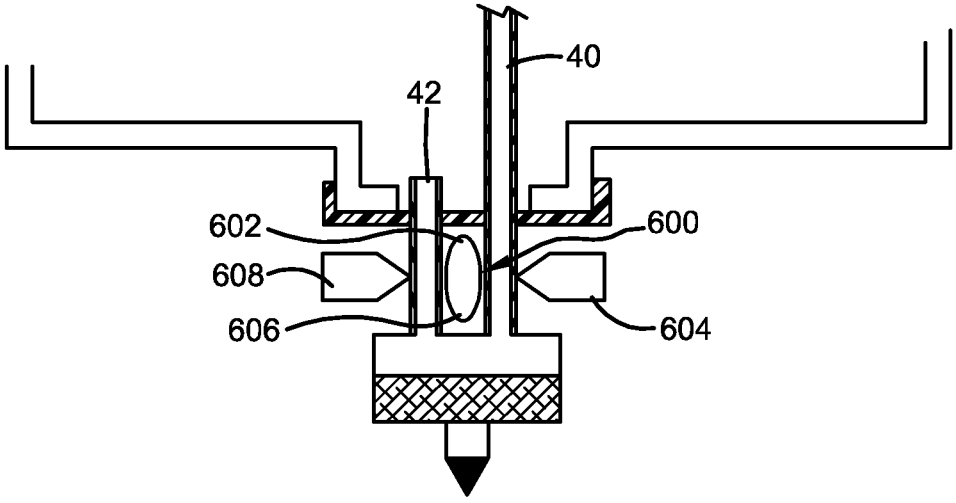
FIG. 14 shows an alternative valve embodiment as compared to the embodiment of FIG. 2, showing the valve in a position where the air tube and liquid tube are open.
Figure 15:
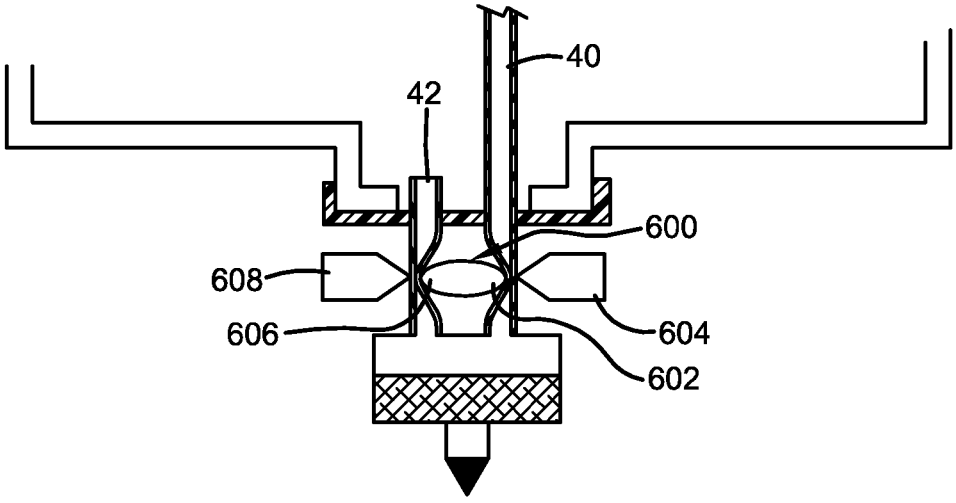
FIG. 15 shows the valve of FIG. 14 moved to close both the air tube and liquid tube.

In yet other embodiments, such as that shown in FIGS. 12 and 13, the valve 54 could consist of a rotating cam 600 shaped such that rotating the cam 600 causes an extension 602 thereof to collapse the tubes 40, 42 against a stop plate 604. The cam 600 could be oval, as shown, or could have a projection or could be a circular member mounted to a shaft at an off-center position. The shape is selected so that the cam can be rotated to take up a position in which the tubes 40, 42 are pinched closed and can be rotated to take up a position in which the tubes are open. As shown in FIGS. 14 and 15, this general concept can also be applied to the embodiment of FIG. 2. The cam 600 is positioned between the tubes 40, 42, and rotates so that, in a first position, neither a first extension 602 nor a second extension 606 affect flow through the tubes 40, 42, while, in a second position, one of the extensions 602 or 606 pinches the air tube 40 against stop plate 604, while the other of the extensions 602 or 606 pinches the liquid tube 42 against a stop plate 608.

Referring back to FIG. 1, a control circuit 60 is maintained as an integral portion of the dispenser 10, preferably within the dispenser housing 12. The control circuit 60 is interconnected with the motor 20 to selectively activate the air compressor 22. Similarly, the control circuit 60 interconnects with the shut-off valve 54 (or valves) to selectively open and close such valve or valves. The proximity sensor 52 is connected to the control circuit 60 to provide a signal when hands are present at the proper dispensing location under the dispensing nozzle 50. Similarly, the pressure sensor 28 is interconnected with the control circuit 60 to provide a signal indicative of the pressure head in the air space 18 of the container 15. Finally, in particular embodiments, the control circuit 60 is also interconnected with the vent valve 30 to allow for venting of the air portion 18 to atmosphere. The control circuit 60 would cause the vent valve 30 to vent to the atmosphere if the pressure in the container 15 builds up beyond a set maximum. In embodiments such as that shown, wherein the inflation plug 26 includes the pressure sensor 28 and the vent valve 30, the inflation plug 26 acts as a safety device to prevent the pressure from building too high in the container 15. Those skilled in the art will appreciate that the valves 30 and 54 may be of various types, while conforming to the concepts of this invention. While they may all be controlled by the control circuit 60, it is contemplated that they may alternatively be self-regulating, automatically controlled as by a set cracking pressure or the like. If a vent valve with a set cracking pressure is employed, there may be no need for control circuitry to actuate the vent valve.

From a structural standpoint, the removal and replacement of a refill unit 14—and the necessary interconnections to be effected at such replacement cycles—is simple and easy to undertake. In the simplest form, the refill unit 14 is first placed within the dispenser housing 12, with the dispensing nozzle 50 positioned at the desired dispensing location and the tubes 40, 42 positioned to be acted upon by the shut-off valve 54. The inflation plug 26, particularly the needle 34, is then mated with the plug receipt 35 so that the compressor 22 can inject air into the container 15. As disclosed above, the shut-off valve 54 acts to selectively open and close the air tube 40 and the liquid tube 42. A more particular mounting concept is shown in FIG. 3.

Referring now to FIG. 3, a concept for achieving an appropriate mounting of a refill unit 14 is shown schematically. The dispenser housing 12 includes a shelf 62 that defines a channel 64 for receipt of the air tube 40 and liquid tube 42. The dispenser housing 12 further includes a mounting plate 66 and guides 68 extending therefrom to create a pocket 70 for receipt of the upper portion 17 of the container 15. The upper portion 17 of the container 15 includes the plug receipt 35 as a piercable member, and the inflation plug 26 is appropriately located in the dispenser housing 12 so that needle 34 of the inflation plug 26 (needle not shown in FIG. 3) pierces the plug receipt 35 when the upper portion 17 of the container 15 is inserted into the pocket 70, the alignment of the needle 34 and the plug receipt 35 being assisted by the guides 68. The upper portion 17 is inserted first and then pushed upwardly to cause the needle 34 to pierce the plug receipt 35. Thereafter, the bottom portion 19 of the container 15 is pushed inwardly to rest on the shelf 62 and place the air tube 40 and the liquid tube 42 in the channel 64. Notably, this method for mounting the refill unit can also be employed for the refill units of the embodiments of FIGS. 2, 4 and 6, and the application of this mounting method to those embodiments will be apparent from the above disclosure and the figures of this application. After mounting, the shut-off valve 54 (or 54') operates in the channel 64, opening and closing the air tube 40 and the liquid tube 42 to selectively prevent and allow fluid flow therethrough.

A third embodiment of a dispenser refill unit is shown mounted to the dispenser housing 12 and designated by the numeral 114 in FIG. 4. The refill unit 114 is in many respects similar to refill unit 14, having a container 115 with a foamable liquid therein defining a liquid portion 116 and an air portion 118. The container 115 also includes a plug receipt 135 for receipt of the needle 34 of a inflation plug 26 just as in the refill unit 14, but the refill unit 114 of this second embodiment, includes a different placement for the foam generator 138 (as compared to foam generator 38). More particularly, the foam generator 138, which, like foam generator 38, includes a mixing chamber 146 and homogenizing member 148, is provided inside of the container 115, the air tube 140 and liquid tube 142 communicating therewith as with the embodiment of FIG. 1. Notably, the foam generator 138 could simply include an inlet aperture to receive liquid into the mixing chamber 146, instead of receiving liquid from an actual liquid tube 142, which, at any rate, is shown as being very short in FIG. 4. A single dispensing tube 149 extends from fluid communication with the foam generator 138 through a sealing cap 144 to present a dispensing nozzle 150 at the exterior of the container 115. The single dispensing tube 149 carries foam created in the foam generator 138 to the dispensing nozzle 150 to be dispensed as in the prior embodiment, and only this single tube must be pinched and released by the shut-off valve 54. Virtually any configuration of components suitable for selectively opening and closing the air tube 40 and liquid tube 42 can be employed as shut-off valve 54, as structures and methods achieving such function are numerous and well known. Additionally, the shut-off valve concepts disclosed herein in FIGS. 1, 12 and 13 could be employed in particular embodiments, the adaptation of those embodiments to the refill unit of FIG. 4 being readily apparent.

Figure 5:
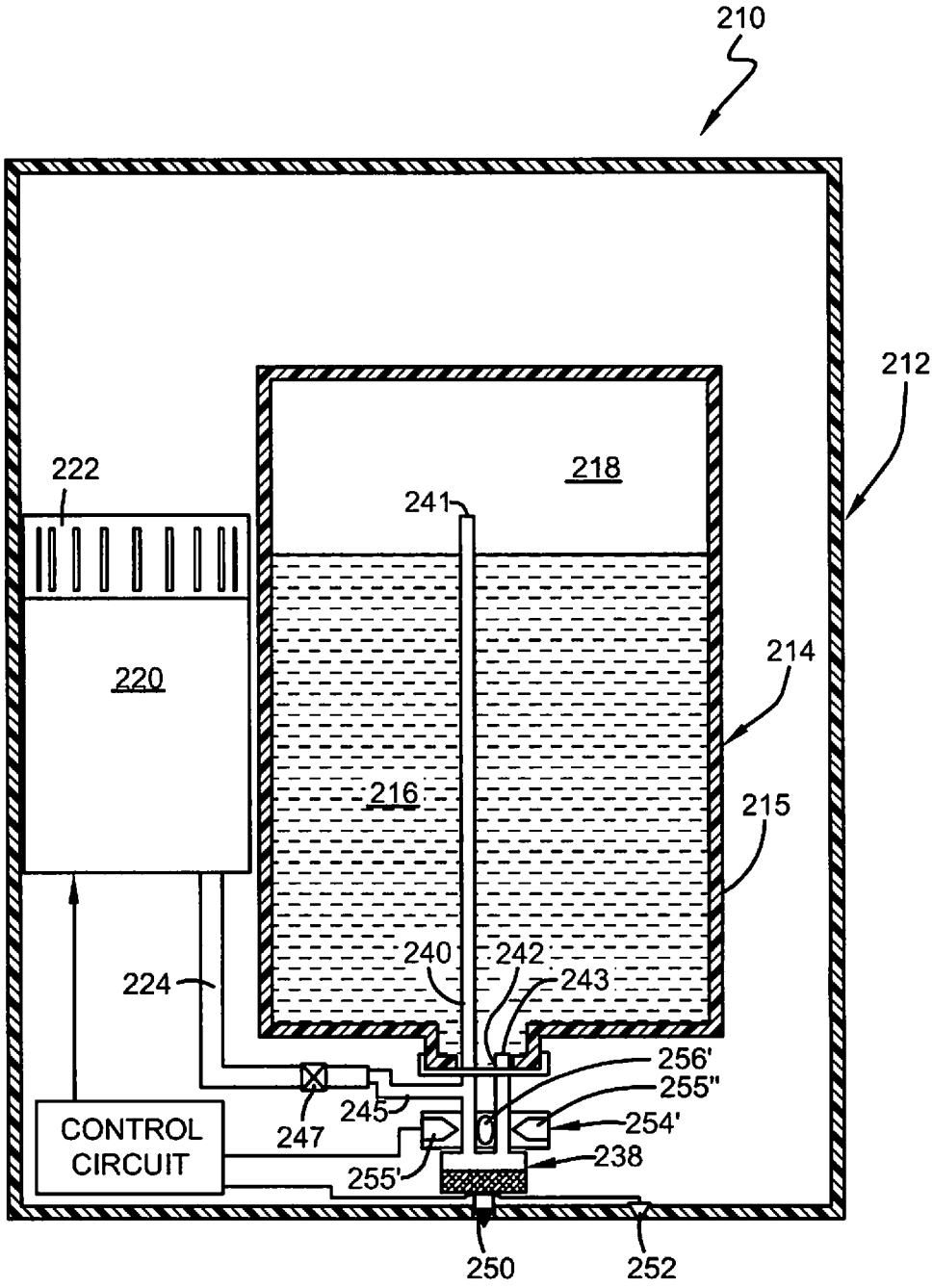
FIG. 5 is a schematic illustrative sectional view of a fourth embodiment of a foam dispenser, and this fourth embodiment differs from that of FIGS. 1, 2 and 4 due to an alternative construct for mating with the air compressor of the dispenser housing.

Referring now to FIG. 5, a third embodiment of a foam dispenser is shown and designated by the numeral 210. This dispenser 210 includes a dispenser housing 212 that receives a refill unit 214. In light of adaptations made to the refill unit 214 (as compared to refill units 14 and 114), a slightly altered dispenser housing 212 is employed in this embodiment. However, because many elements are similar, like parts receive like numerals though increased by 200 as compared to the embodiment of FIG. 1 and increased by 100 as compared to the embodiment of FIG. 4. In this embodiment, the refill unit 214 has been adapted to receive air from the compressor 222 through its air tube 240 rather than through a separate inflation plug member, as with inflation plug 26 of prior embodiments.

The refill unit 214 includes a container 215 with a foamable liquid retained therein to define a liquid portion 216 and an air portion 218. As with prior embodiments, an air tube 240 extends from one end that is in fluid communication with a foam generator 238 to an inlet end 241 in direct communication with the air portion 218. A liquid tube 242 extends from one end that is in fluid communication with the foam generator 238 to an inlet end 243 in direct communication with the liquid portion 216. In this regard, the refill unit 214 has an air and liquid tube and foam generator structure very similar to that of FIG. 2, and can have a very similar shut-off valve as well. Virtually any configuration of components suitable for selectively opening and closing the air tube 40 and liquid tube 42 can be employed as the shut-off valve, as structures and methods achieving such function are numerous and well known. Additionally, the shut-off valve concepts disclosed herein in FIGS. 2, 14 and 15 could be employed in particular embodiments, the adaptation of those embodiments to the refill unit of FIG. 5 being readily apparent. In particular embodiments, the dispenser housing 212 includes a shut-off valve 254' including a single stop plate 256' positioned between the air tube 240 and the liquid tube 242 so that a separate air sealing bar 255' and liquid sealing bar 255" can each separately move to press against the stop plate 256 and close off their respective tubes. In this embodiment, a port 245 extends off of the air tube 240 outside of the container 215, below the sealing cap 244 and above the valve 254'.

The compressor tube 224 extending from the air compressor 222 is sealingly mated with this port 245, and a valve and pressure sensor assembly generally represented at 247 is associated with the compressor tube 224 in order to sense the pressure within the tube 224 and close off the same (through operation of the valve) as necessary. Thus, it will be appreciated that the compressor 222 can pressurize the container 215, as in prior embodiments, though through the air tube 240.

A control circuit 260 is maintained as an integral portion of the dispenser 210, preferably within the dispenser housing 212. The control circuit 260 is interconnected with the motor 220 to selectively activate the air compressor 222. Similarly, the control circuit 260 interconnects with the shut-off valve 254' and valve and pressure sensor assembly 247 to selectively open and close the valves, when appropriate. The proximity sensor 252 is connected to the control circuit 260 to provide a signal when hands are present at the proper dispensing location under the dispensing nozzle 250. The valve and pressure assembly 247 can be designed to vent to the atmosphere (under control of the circuit 260) if the pressure in the container 215 becomes too high, or the container 215 could be fitted with a valve having a set cracking pressure and communicating with the air portion 218.

In the prior embodiments of FIGS. 1-5, the dispensers are intended to dispense foam and include both air tubes and liquid tubes to advance air and liquid to a foam generator. Realizing that the present concepts can be employed to dispense liquid products that have not been foamed with the addition of air, a liquid dispenser 310 is shown in FIG. 6. This embodiment is very similar to the embodiment of FIG. 1 and therefore identical numerals are employed to identify identical elements of the dispenser housing 12. It will be appreciated that the main distinction between the dispenser 310 of FIG. 6 and the dispenser 10 of FIG. 1 resides in the structure of the refill unit 314 as compared to the refill unit 14. Particularly, refill unit 314 includes only a liquid tube 342 extending from the sealing cap 344 and fluidly communicating with the liquid portion 316 in the container 315. This single liquid tube 342 is preferably flexible so that it may be opened and closed by operation of valve 54. Virtually any configuration of components suitable for selectively opening and closing the liquid tube 42 can be employed, as structures and methods achieving such function are numerous and well known. Additionally, the valve concepts disclosed herein in FIGS. 1, 12 and 13 could be employed in particular embodiments, the adaptation of those embodiments to the refill unit of FIG. 6 being readily apparent. In this embodiment, no foam generator is needed. Instead, the liquid tube 342 extends to a dispensing nozzle 350 without having to pass through a foam generator. In all other respects, this embodiment is similar to that of FIG. 1 and includes an air compressor 22 operated by a motor 20 to force air through compressor tube 24 and through the inflation plug 26. The inflation plug 26 includes a needle 34 that extends through a plug receipt 335 so that the compressor 22 can inject air into the air portion 318 of the container 315. The inflation plug 26 can include a pressure sensor 28 and vent valve 30 communicating with a control circuit 60. A sensor 52 appropriately positioned to sense the presence of a hand below the dispensing novel 50 will also communicate with the control circuit 60.

In the embodiments of FIGS. 1, 2, 4 and 6, the control circuit 60 operates the motor 20 (and thus the air compressor 22), the shut-off valve 54 (or 54'), and the pressure sensor 28 and vent valve 30 (in embodiments in which the sensor 28 and valve 30 are employed) to dispense product, and can do so in numerous ways. The flexibility of the operational mode is apparent, in that the control circuit 60 may comprise a simple programmable chip, the program achieving the desired operation.

Figure 7:
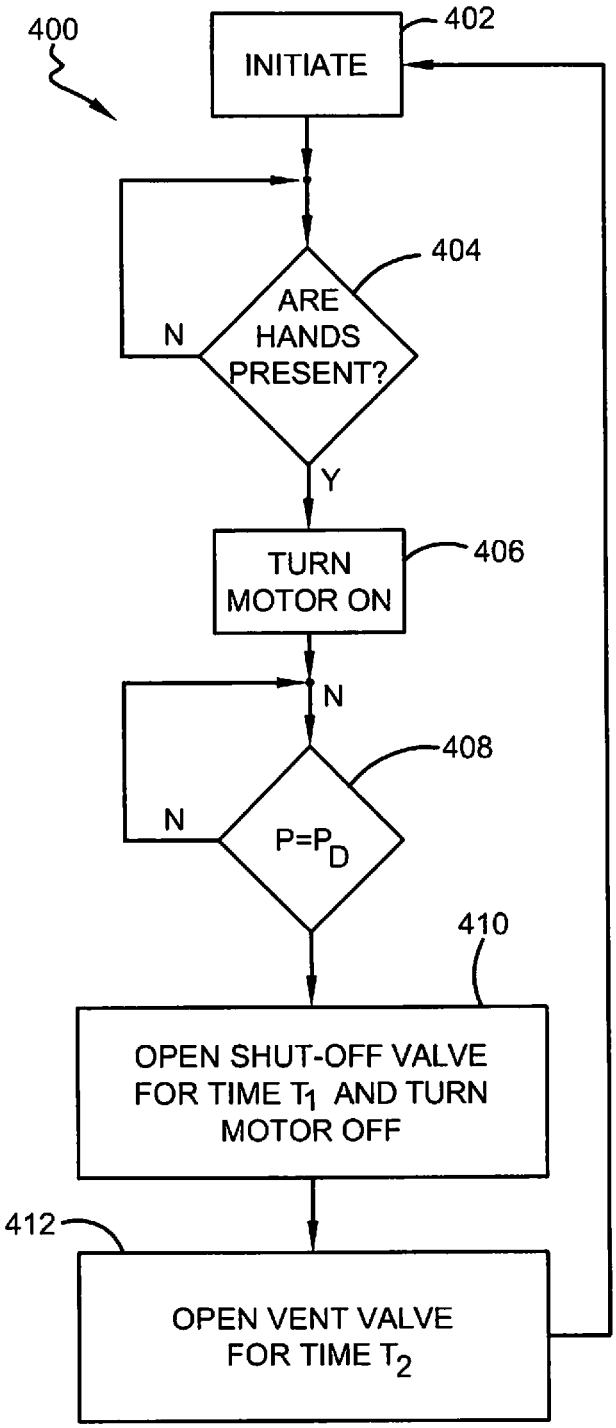
FIG. 7 is a flow diagram showing a manner of operation of dispensers in accordance with this invention.

One example of an acceptable operation is illustrated in the flow chart of FIG. 7, in which a method of operation is designated generally by the numeral 400. An initiate cycle 402 resets the control circuit 60 and ensures closure of the valves 30, 54 (or 54'), as desired. Following the initiate cycle at 402, the proximity sensor 52 is monitored as at 404 to determine if hands are present. That monitoring continues until a determination is made that hands are present below the dispensing nozzle 50, 150, 350, in which case the motor 20 is activated as at 406, which in turn activates the compressor 22 to provide compressed air through the tube 24, out the needle 34 and into the air portion 18, 118, 318. The control circuit 60 continues to monitor the pressure in the air portion 18, 118, 318 through the pressure sensor 28, as at 408. When the pressure P maintained in the air portion 18, 118, 318 is equal to dispensing pressure $P_D$, a determination is made, as at 410, that dispensing can be engaged, and so the motor is turned off and the shut-off valve 54 (or 54') opened for a time $T_1$.

In the foam-generating embodiments of FIGS. 1, 2 and 4, the opening of the shut-off valve 54 (or 54') will cause air to be driven from the air portion 18, 118 through the air tube 40, 140, and into the foam generator 38, 138. It will also cause liquid to be driven from the liquid portion 16, 116 of the container 15, 115, through the liquid tube 42, 142 and into the foam generator 38, 138. At the foam generator, the air and liquid mix to create a foam product. For example, the liquid in the container 15, 115 may be chosen to be a foamable soap, in which case a foamed soap is created. In embodiments such as that in FIG. 2, wherein separate sealing structures (55' and 55") are employed for the air tube and liquid tube, the control circuit 60 could be programmed to open one tube before another. In the embodiment of FIG. 6, there is no air tube, and opening the shut-off valve 54 will cause liquid to be advanced to the dispensing nozzle 350. The shut-off valve 54 (or 54') remains open for a predetermined time $T_1$, this time being an adequate time cycle for dispensing a predetermined volume of foam (or liquid in the case of refill unit 314).

It will be understood that when the dispensing valves are opened as at 410, the motor 20 may be turned off under control of the control circuit 60. If desired, the motor and compressor may remain on and operative during the dispensing cycle, or the same can be turned off prior to the dispensing cycle, relying upon the pressure head within the air portion 18, 118, 318 to effect the dispensing of foam (or liquid only in the case of refill unit 314). In either event, once the motor 20 and compressor 22 have been turned off and the dispensing cycle has been terminated, action may be undertaken at 412 to open the vent valve 30 to vent the pressure head in the air portion 18, 118, 318 to atmosphere. The vent valve 30 may be opened for a set period of time $T_2$ sufficient for such venting, or the vent valve 30 may be opened to atmosphere until the pressure sensor 28 emits a signal indicating the absence of pressure or the presence of atmospheric pressure. In any event, venting through the vent valve 30 is desired to prevent over-pressurization of the refill unit 14, 114, 314 which may result in a leak or excessively forceful dispensing of foam. Thus, if the pressure in the container 15, 115, 315 rises above a set threshold programmed into the control circuit 60, the control circuit 60 will open the vent valve 30 to reduce that pressure. Similarly, the vent valve 30 could be designed to have a cracking pressure at which it would open, and thus the threshold pressure would be designed into the vent valve 30, and the control circuit 60 would not have to be programmed with respect to this pressure venting feature.

Figure 8:
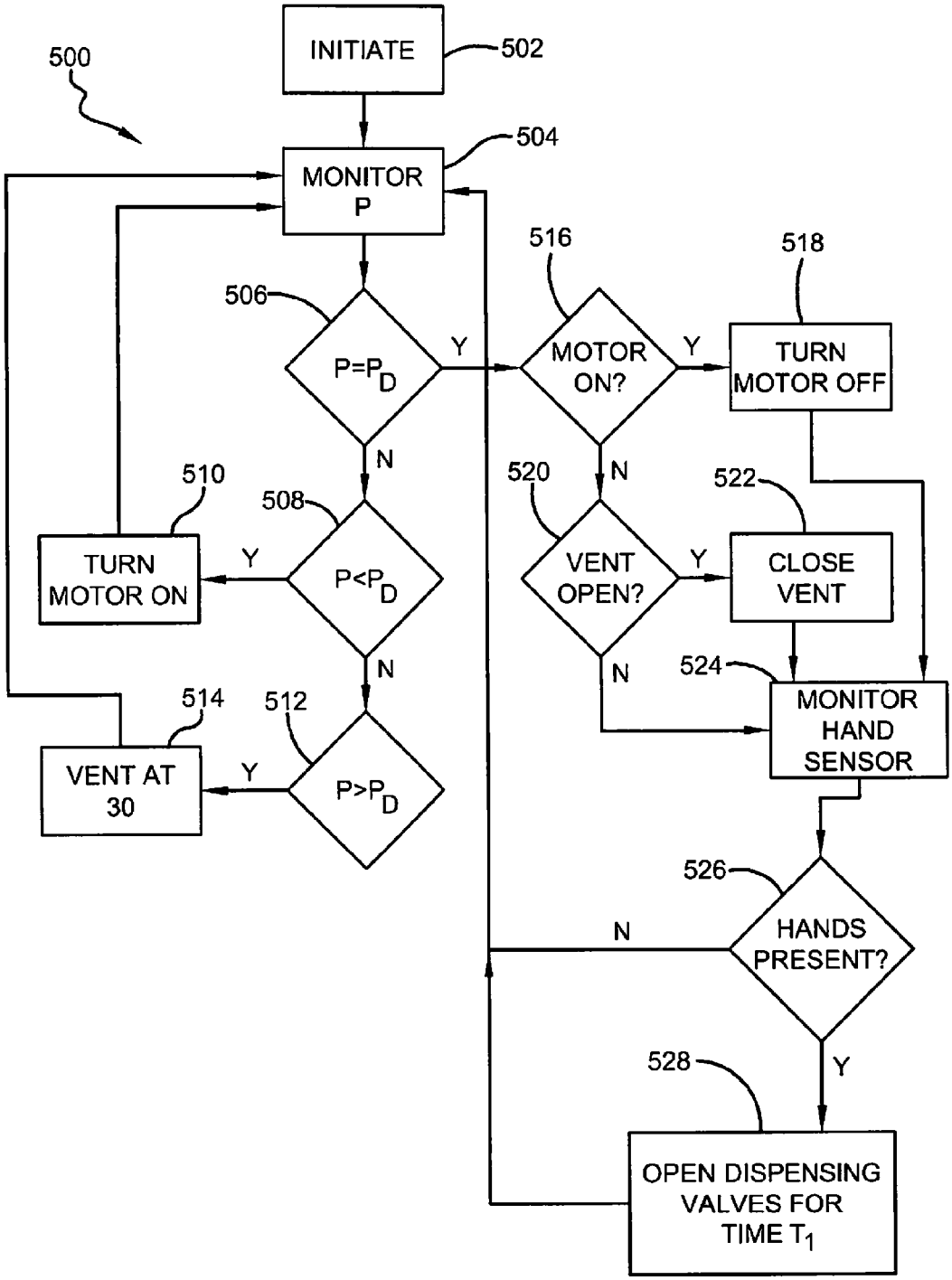
FIG. 8 is a flow diagram showing a second manner of operation of dispensers in accordance with this invention.

A second example of an acceptable operation is illustrated in the flow chart of FIG. 8, wherein a method of operation is designated generally by the numeral 500. In this operational mode, it is intended that the refill unit 14, 114, 314 always be pressurized to an appropriate pressure when at rest, i.e., when no hands are present at the sensing position of the proximity sensor 52. In this way, when a hand is sensed by the proximity sensor 52 there is no need for the system to begin pressurizing the refill unit 14, 114, 314 as in the prior operation mode disclosed above. Instead, the shut-off valve 54 (or 54') can simply be opened for the appropriate amount of time to dispense a desired dose of product at dispensing nozzle 50.

In FIG. 8, an initiate cycle 502 resets the control circuit 54 and ensures closure of the shut-off valve 54 (or 54') and vent valve 30. Following the initiate cycle at 502, the control circuit 60 constantly monitors the pressure P within the refill unit 14, 114, 314 as at 504. The pressure P is monitored for comparison against a desired pressure or pressure range herein referred to as a desired pressure $P_D$. At 506, the monitored pressure P is compared to the desired pressure $P_D$ to determine if P equals $P_D$. Herein, it should be understood that, if $P_D$ is a pressure range, P equals $P_D$ when P is within that pressure range. If the monitored pressure P is not equal to the desired dispensing pressure $P_D$, the monitored pressure P is compared to the desired pressure $P_D$ to determine if P is less than $P_D$, as at 508. If the pressure P is less than $P_D$, the motor is turned on, as at 510, and, if the pressure P is not less than $P_D$, it is necessarily greater than $P_D$, as determined at 512, in which case the pressure is released by venting the refill unit 14, 114, 314 at the vent valve 30 of the inflation plug 26, as at 514. Whether the motor 20 is turned on, as at 510, or the vent valve 30 is opened, as at 514, the pressure P is monitored, as at 504, and, once the pressure $P_D$ is reached, either the motor is turned off, as at 516, 518, or the vent is closed, as at 520, 522, to establish the pressure P at the desired pressure or pressure range $P_D$. Through such pressurizing and/or venting, as necessary, the pressure P is brought to the desired dispensing pressure or pressure range $P_D$, and the system can then monitor proximity sensor 52, as at 524, to determine if hands are present.

At 526, if hands are not present, the control circuit continues to monitor the pressure, as at 504, and to make adjustments thereto, if necessary, as at 510 and 514. This monitoring helps to ensure that any pressure loss, as perhaps through imperfect seals at plug receipt 35, 135, 335 or sealing cap 44, 144, 344 is corrected, as well as any pressure gain, perhaps through a rise in temperature within the refill unit 14, 114, 315.

In the foam-generating embodiments of FIGS. 1, 2 and 4, if hands are present when the pressure P is equal to $P_D$, the control circuit 60 opens the shut-off valve 54 (or 54'), as at 528, to allow for air to be driven from the air portion 18, 118, through the air tube 40, 140 and into the foam-generator 38, 138. Simultaneously, actuation of the shut-off valve 54 allows for foamable liquid to be driven from the liquid portion 16, 116 of the refill unit 14, 114, through the liquid tube 42, 142 and into the foam generator 38, 138. In embodiments such as that in FIG. 2, wherein separate sealing structures (55' and 55") are employed for the air tube and liquid tube, the control circuit 60 could be programmed to open one tube before another. In the embodiment of FIG. 6, there is no air tube, and opening the shut-off valve 54 will cause liquid to be advanced to the dispensing nozzle 350. The shut-off valve 54 (or 54') remains open for a predetermined time $T_1$, this time being an adequate time cycle for dispensing a predetermined volume of foam (or liquid in the case of refill unit 314) under the desired pressure or pressure range $P_D$. Once the product is dispensed, the system goes back to monitoring pressure at 304.

In other embodiments, the air compressor 22 is designed to generate a maximum pressure, Pmax, which is within the desired dispensing pressure range, $P_D$, such that the refill unit 14, 114, 315 is not likely to ever be pressurized to a pressure that is greater than $P_D$, and the vent valve 30 may be eliminated, along with the venting step in the flowcharts. The elimination of the vent valve 30 decreases the cost of the inflation plug 26. Also, even if the pressure sensor 28 fails, there is little chance that the pressure in the container 15, 115, 315 will exceed the desired range $P_D$.

In the embodiment of FIG. 5, where the compressor 22 injects air into the container 215 through the air tube 240, the above procedures generally apply, but the valve and pressure sensor assembly 247 would function and be controlled substantially as the inflation plug of other embodiments. However, it will be appreciated that the assembly 247 will have to shut off the air tube 240 before the shut-off valve 254' is opened to permit dispensing, otherwise the air could be directed toward the air compressor 222, thereby affecting the air to liquid ratio realized at the foam generator.

In a particular embodiment in accordance with either the system of FIG. 7 or FIG. 8, the pressure is monitored and maintained at from 2 to 10 psi when the dispenser is unactuated and at rest, i.e., $P_D$ is from 2 to 10 psi. In other embodiments, $P_D$ is from 3 to 6 psi, and in yet other embodiments, form 3 to 5 psi. In another embodiment, the liquid is chosen from gel hand sanitizer products and liquid soap products, and $P_D$ is from 3 to 5 psi.

In a particular embodiment in accordance with either the system of FIG. 4 or FIG. 5, the time $T_1$ that the shut-off valve 54 remains open to dispense product is from 0.01 to 1.0 second. In other embodiments, the time $T_1$ is from 0.25 to 0.75 seconds, and, in other embodiments, from 0.25 to 0.5 seconds.

Though in the preferred embodiments shown, the foam generator 38, 138 is shown as being part of the refill unit 14, 114, it should be appreciated that it would be possible to provide a refill unit 14, 114 having an air tube 40, 140 and liquid tube 42, 142 that are to be mated with a foam generator 38, 138 that remains a more permanent part of the dispenser housing. However it is preferred, as shown, that the foam generator 38, 138 remain a part of the refill unit 14, 114 so that all wetted parts of the dispenser are periodically disposed of to ensure that the dispenser remains sanitary. This concept is well known to be preferable at least the soap and sanitizer dispensing arts. In particular embodiments of this invention, the foamable liquid creating the liquid portion 16, 116 is soap or sanitizer that is capable of foaming when mixed with air. Such soap and sanitizer formulations are currently well known and are continually being developed and improved upon.

Notably, in one or more embodiments, the refill units of the present invention are devoid of any vent valves, which, if employed, are provided as part of an inflation plug of the present dispensers or elsewhere in the more permanent dispenser housings so that the refill units can be manufactured more cost effectively. Additionally, in the present refill units, the air and liquid tubes extend from the bottom of the container, in the dispensing direction, and therefore need not be threaded through the dispenser housing as, for example, in U.S. Patent Application No. 2010/0102083. In preferred embodiments of the present refill units 14, 114, a single plug receipt presents the only location of the container 15, 115 that is eventually compromised by engagement with a needle 34 of an inflation plug 26. Although tubes such as air tube 40, liquid tube 42 and dispensing tube 149 do extend through their respective containers 15, 115 of their respective refill units 14, 114, they extend through sealing caps 44, 144 in air-tight manner that is not easily compromised. The present refill units are devoid of moving parts, the air and liquid being driven therethrough by the air compressor retained by the dispenser housing. The present invention also provides a simplified and improved method for mounting refill units in that the invention proposes that the proper insertion of the refill unit into the dispenser housing can result in the mating of the needle of the inflation plug and the plug receipt of the container, simply by insertion of the container of the refill unit into a pocket of the dispenser housing, where the inflation plug is located to appropriately align with the plug receipt. After such insertion, the tube or tubes extending through the sealing cap of the refill unit can be placed in a channel where valve structures serve to act upon the tube(s) to open and close them as necessary to dispense product.

Thus it can be seen that the various aspects of the invention have been attained by the structure presented and describe above. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be made to the following claims.

What is claimed is:

1. A refill unit for a liquid product dispenser, wherein the refill unit replaces an empty refill unit in the product dispenser, when necessary, the refill unit comprising:

(a) a container holding a liquid product, said container including a plug receipt providing access to the interior of said container, said plug receipt structured to receive an inflation plug so as to mate with the inflation plug in a sealed manner and said plug receipt sealing the contents of the container;

(b) a dispensing nozzle external of said container and fluidly communicating with said liquid product, wherein pressurizing said container forces liquid out of said container and forces liquid out of said dispensing nozzle, the refill unit being devoid of means for venting pressure generated in the interior of said container other than by venting through said dispensing nozzle.

2. The refill unit of claim 1, wherein the refill unit is devoid of moving parts necessary to advance said liquid product out of said container.

3. The refill unit of claim 2, wherein the liquid product dispenser is a hand treatment product dispenser, and said liquid product is selected from hand sanitizer and soap.

4. The refill unit of claim 1, further comprising an air tube fluidly communicating with an air portion within said container, wherein pressurizing said container forces air in said air portion through said air tube.

5. The refill unit of claim 4, further comprising:

a foam generator, said dispensing nozzle and said air tube fluidly communicating with said foam-generating assembly.

6. The refill unit of claim 1, wherein said foam generator is located outside of said interior of said container, the refill unit further comprising a liquid tube fluidly communicating with said liquid product inside said container and extending exteriorly of said container to fluidly communicate with said foam generator.

7. The refill unit of claim 1, wherein said foam generator is located at least partially within said interior of said container.

8. A dispenser comprising:

(a) a dispenser housing including:

an air compressor, an inflation needle fluidly associated with said air compressor such that operation of said air compressor advances air through said inflation needle and out an outlet of the inflation needle, and a vent valve; and (b) a disposable refill unit separate and distinct from said dispenser housing, to be replaced when empty, said refill unit including:

a container having an interior holding a liquid product, and a plug receipt provided in said container, wherein said refill unit is mounted in said dispenser housing, said inflation needle of said dispenser housing communicates with said interior of said container through said plug receipt, and said vent valve fluidly communicates with the interior of said container, said air compressor injecting air into said interior of said container through said outlet of said needle to increase the pressure inside said container, said vent valve opening if the pressure of said container rises above a set threshold.

9. The dispenser of claim 8, wherein the vent valve has a set cracking pressure such that it opens on its own when the pressure of said container rises above said set threshold.

10. The dispenser of claim 8, further comprising one or more control circuits, wherein a control circuit associated with said vent valve causes said vent valve to open when the pressure of said container rises above said set threshold.

11. The dispenser of claim 8, wherein said container includes an air portion therein, and said refill unit further comprises:

a foam generator, and an air tube fluidly communicating with the air portion of said container and extending to fluidly communicate with said foam generator.

12. The dispenser of claim 11, wherein said foam generator is positioned at least partially within said interior of said container.

13. The dispenser of claim 12, wherein said foam generator fluidly communicates with said liquid product in said container, wherein said air compressor generates a pressure head in said air portion, said pressure head separately forcing both air and said liquid product respectively through said air tube and said liquid tube to said foam generator.

14. The dispenser of claim 13, wherein said refill unit further comprises a dispensing tube extending from said foam generator to receive foam formed in the foam generator from the mixing of said air and said liquid product, and said dispenser housing includes a valve for opening and closing said dispensing tube.

15. The dispenser of claim 11, wherein said foam generator is positioned exteriorly of said container, and said air tube extends exteriorly of said container to communicate with said foam generator, said refill unit further comprising a liquid tube communicating with the liquid product in said container, said liquid tube extending exteriorly of said container to fluidly communicate with said foam generator.

16. The dispenser of claim 15, wherein said dispenser housing further comprises at least one dispensing valve for opening and closing said air tube and said liquid tube exteriorly of said container.

17. The dispenser of claim 16, wherein said dispenser housing includes two dispensing valves, one for opening and closing said air tube and one for opening and closing said liquid tube.

18. The dispenser of claim 8, wherein said dispenser housing includes a pocket into which said container is inserted to mount said refill unit to said dispenser housing, said inflation needle being positioned at said pocket such that, as said container is inserted into said pocket, said plug receipt aligns with said inflation needle, and full insertion of said container causes said inflation needle to extend through said plug receipt such that said outlet of said needle communicates with said interior of said container.

19. The dispenser of claim 8, wherein said plug receipt is in the form of a resilient grommet having a piercable wall.

20. The dispenser of claim 8, wherein said plug receipt is in the form of a self-sealing passage.

* * * * *